US005501154A

United States Patent [19]

Rodney et al.

[11] Patent Number: 5,501,154

[45] **Date of Patent: *Mar. 26, 1996**

[54] SUBSTANTIALLY LEAD-FREE TIN ALLOY SHEATH MATERIAL FOR EXPLOSIVE-PYROTECHNIC LINEAR PRODUCTS

[75] Inventors: Stanley Rodney; Larry H. Barr, both of Hollister, Calif.

[73] Assignee: Teledyne Industries, Inc., Los Angeles, Calif.

[ * ] Notice: The portion of the term of this patent shall not extend beyond the expiration date of Pat. No. 5,333,550.

[21] Appl. No.: 260,274

[22] Filed: Jun. 14, 1994

Related U.S. Application Data

[63] Continuation-in-part of Ser. No. 86,260, Jul. 6, 1993, Pat. No. 5,333,550.

[51] Int. Cl.[6] ..... F42B 3/00

[52] U.S. Cl. ..... 102/331; 102/307

[58] Field of Search ..... 102/307, 331

[56] References Cited

U.S. PATENT DOCUMENTS

| | | | |
|---|---|---|---|
| Re. 29,239 | 5/1977 | Hyner et al. | 75/175 R |
| 2,180,139 | 11/1939 | Deitz | 75/93 |
| 2,471,899 | 5/1949 | Regner | 75/63 |
| 2,867,550 | 1/1959 | Weber | 117/200 |
| 3,112,700 | 12/1963 | Gehring | 102/20 |
| 3,433,156 | 3/1969 | Suzuki et al. | 102/39 |
| 3,607,253 | 9/1971 | Cain | 75/175 A |
| 3,675,575 | 7/1972 | Bailey et al. | 102/24 HC |
| 3,734,020 | 5/1973 | Ciccone et al. | 102/40 |
| 3,881,919 | 5/1975 | Hyner et al. | 75/175 R |
| 3,903,800 | 9/1975 | Kilmer | 102/27 R |
| 3,945,556 | 3/1976 | Manko | 228/263 |
| 4,099,464 | 7/1978 | Cross et al. | 102/24 HC |
| 4,290,366 | 9/1981 | Janoski | 102/202.3 |
| 4,356,768 | 11/1982 | Cord et al. | 102/275.9 |
| 4,422,381 | 12/1983 | Barrett | 102/202.2 |
| 4,670,217 | 6/1987 | Henson | 420/562 |
| 4,766,813 | 8/1988 | Winter et al. | 102/307 |
| 4,794,990 | 1/1989 | Riggs | 166/902 |
| 4,806,309 | 2/1989 | Tulman | 11/11 |
| 4,962,003 | 10/1990 | Lhymn et al. | 428/614 |
| 5,024,159 | 6/1991 | Walley | 102/323 |
| 5,024,160 | 6/1991 | Canterberry et al. | 102/289 |
| 5,062,365 | 11/1991 | Canterberry | 102/322 |
| 5,175,391 | 12/1992 | Walters et al. | 102/307 |
| 5,333,550 | 8/1994 | Rodney et al. | 102/331 |

*Primary Examiner*—Peter A. Nelson
*Attorney, Agent, or Firm*—David H. Semmes

[57] ABSTRACT

A binary, ternary and/or quaternary substantially lead-free tin alloy composition that may be used as outer sheath material in various explosive-pyrotechnic linear products, such as ignition cord, mild detonating cord (MDC) and linear shaped charge (LSC).

5 Claims, 1 Drawing Sheet

SUBSTANTIALLY LEAD-FREE TIN ALLOY SHEATH MATERIAL FOR EXPLOSIVE-PYROTECHNIC LINEAR PRODUCTS

CROSS-REFERENCE TO RELATED APPLICATIONS

A Continuation-in-Part of TIN ALLOY SHEATH MATERIAL FOR EXPLOSIVE-PYROTECHNIC LINEAR PRODUCTS (Ser. No. 08/086,260), filed Jul. 6, 1993, now U.S. Pat. No. 5,333,550.

The present application is directed to compositions embodying less than 1.5% lead impurities.

BACKGROUND OF THE INVENTION

1. Field of the Invention

Ignition cord and mild detonating cord, particularly a substantially lead-free tin alloy composition for use as a sheath material for various explosive-pyrotechnic linear products.

2. Description of the Prior Art

| A. Applicant's Search | |
|---|---|
| HYNER et al. | Re. 29/239 |
| HYNER et al. | 3,881,919 |
| DEITZ | 2,180,139 |
| REGNER | 2,471,899 |
| WEBER | 2,867,550 |
| GEHRING | 3,112,700 |
| SUZUKI et al. | 3,433,156 |
| MANKO | 3,945,556 |
| JANOSKI | 4,390,266 |
| BARRETT | 4,422,381 |
| TULMAN | 4,806,309 |
| LHYMN et al. | 4 962,003 |
| WALLEY | 5,024,159 |
| CANTERBERRY et al. | 5,024,160 |
| CANTERBERRY | 5,062,365 |
| B. Cited in Parent Application: | |
| CICCONE et al. | 3,734,020 |
| KILMER | 3,903,800 |
| LORD | 4,556,768 |

The foregoing patents are discussed in a separately filed INFORMATION DISCLOSURE STATEMENT.

SUMMARY OF THE INVENTION

The present invention is directed to a binary, ternary and/or quaternary substantially lead-free, tin-based alloy composition that can be used as an outer sheath material in various explosive pyrotechnic products.

The standard explosive/pyrotechnic linear sheath material in use for years has included a high proportion of lead (90–96%), together with antimony (4–10%) by weight. The lead/antimony tube was economical and provided ease of manufacture and reliability of performance in terms of low melt temperature, high mass, efficient heat transfer of the encased explosive/pyrotechnic and sufficient hoop strength to contain the explosive/pyrotechnic before function.

The large quantifies of lead and antimony conventionally used in such conventional explosive sheath materials have raised concern about the dangers of firing these materials and consequently producing lead particulates. Manifestly, the release of lead particulates into the airborne environment can be an occupational health hazard.

As a result, attempts have been made to eliminate lead from outer metallic sheath coverings of explosive/pyrotechnic linear products. The present invention is directed to three (3) types of linear explosive products, as follows:

1. Ignition Cord—various fuel/oxidizer mixes of pyrotechnic material are loaded into lead-free tin alloy metallic tubes which are processed by a mechanical reduction method of swaging and drawing, so as to produce a linear product that can be used as a deflagrating ignition source for all types of propellant gas generators or solid propellant. The coreload can range from a fraction of a grain per foot to several hundred grains per foot depending upon the application. See FIG. 1.
2. Mild Detonating Cord (MDC)—a secondary detonating type of explosive, such as PETN, RDX, HNS, DIPAM, HMX, CH-6 and PBX-5, is loaded into a lead-free tin alloy metallic tube and then processed mechanically by swaging and drawing into a round circular cross-section containing any specified coreload (grains/ft). See FIG. 1.
3. Linear Shaped Charge (LSC)—a secondary detonating type of explosive, such as PETN, RDX, HNS, DIPAM, HMX, CH-6 and PBX-5, is loaded into a lead-free tin alloy metallic tube and then processed by mechanically swaging and roll forming or stationary die swaging into a chevron-shaped or house-shaped "Vee" that is capable of cutting various target materials using the Monroe effect of penetration and/or severance. See FIG. 2.

DESCRIPTION OF THE PREFERRED EMBODIMENTS

A ternary composition of 96.5% tin, 1.5% copper and 2.0% antimony by weight has been formed into a tube and then loaded with pyrotechnic ignition or detonating materials and found to be capable of being reduced in size by swaging and drawing to a smaller diameter. The tube may then be used to successfully ignite propellant grains and/or produce detonation velocity.

A binary composition consisting of a 97% tin and 3% antimony by weight has been formed into tube, then filled with ignition power. The filled tube was then processed into smaller diameters of 0.062 inch and 0.072 inch and tested for ignition capability in gas generators.

A quaternary composition consisting of 98.5% tin, 1% bismuth, 0.25% copper and 0.25% silver was formed into a tube and filled with a fuel/oxidizer pyrotechnic initiation mix. The tubes were then mechanically processed, using swaging and drawing to achieve tube diameter reductions sufficient for use as a low coreload propellent ignition material. The tubes had only minute traces of other materials and could be considered as substantially free of both lead and antimony.

The metallic tubes utilized in this invention may be classified as modern pewter alloy. Specification ANSI/ASTM B-560 lists a Type 3 special alloy that wa used in 2 of the 3 experiments. The quarternary tube composition including 98.5% tin exceeds the ANSI/ASTM B-560 specification for a tin composition (98% by weight) and, also, did not contain antimony.

Figure 1:
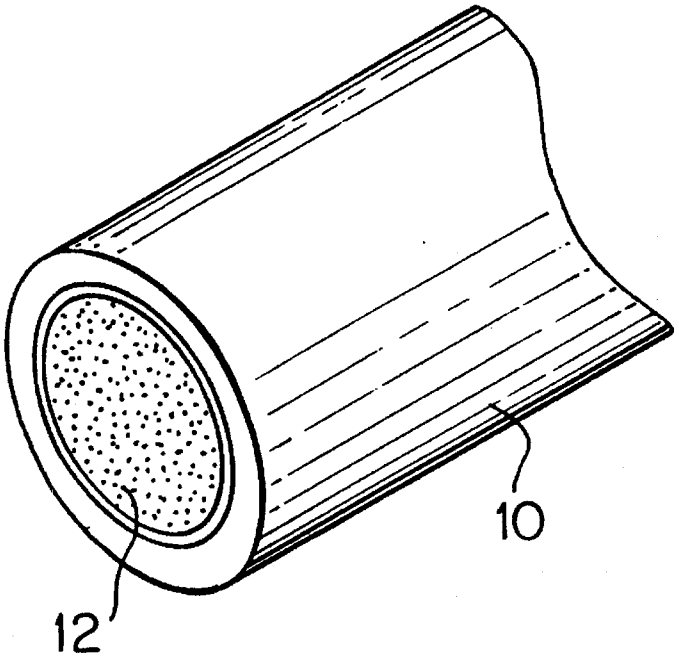
FIG. 1 is a fragmentary perspective depicting an ignition cord or mild detonating cord sheath constructed of the present tin alloy composition and enclosing various fuel/oxidizer mixes or explosives.

The ignition cord, sic MDC, is represented in FIG. 1, wherein the circular cross-section defines the other sheath 10 consisting of substantially lead-free tin alloy based composition; whereas, the ignition powder or explosive is designated item 12.

Figure 2:
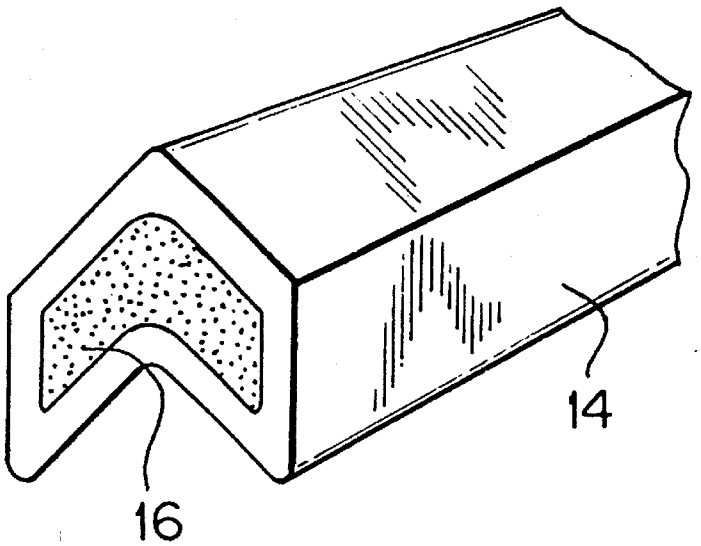
FIG. 2 is a fragmentary persepective of a linear shaped charge according to the present invention and enclosing an explosive core.

The chevron cross-section of FIG. 2 defines the external substantially lead-free tin alloy sheath 14, and in this illustration, the explosive powder is designated 16.

The present invention has demonstrated that a tin-based lead-free composition formed in the shape of a hollow tube may be filled with pyrotechnics either in form of ignition powder or detonating powder and then processed mechanically into a reduced diameter for specific applications.

It has been found that when the tin/antimony proportions are 90%/5%, respectively, and combined with copper or bismuth, the loaded tube filled with ignition or explosive powder becomes too brittle and cannot withstand mechanical processing, so as to achieve reduction in tube cross-section without cracking.

The following experiments have been performed according to the preferred embodiments of the present invention:

EXPERIMENT NO. 1

An ignition linear cord was processed as a start tube having the following composition (percentage proportions by weight):

Tin 96.5%

Antimony 2.0%

Copper 1.5%

A chemical analysis of the above start tube tin alloy composition resulted in the following percentage proportions by weight:

Tin (Balance)

| | | |
|---|---|---|
| Antimony | 1.98% | |
| Copper | 1.46% | |
| Silver | <.002% | < = less than |
| Bismuth | <.002% | |
| Iron | <.002% | Gold, Indium and |
| Arsenic | <.002% | Cadmium were not |
| Zinc | <.002% | detected |
| Aluminum | <.002% | |
| Cadmium | <.002% | |
| Lead | <.02% | |

The tube size was 1.00×0.750 I.D.×10' LTG. It was filled with an Hydro-Borate fuel/oxidizer ignition powder, and was processed through multi-swaging and drawing reduction to arrive at a 6 grains/ft—0.073 inch outer diameter and a 6 grains/ft—0.063 inch outer diameter.

Testing indicated propagation velocities of 10,000–14,000 inches/sec. which were faster on average than previously tested lead/antimony sheath samples of the same ignition material and same length.

EXPERIMENT NO. 2

An ignition cord consisting of an Hydro-Borate rapid deflagrating powder was processed using a tube composition with the following percentage weight proportions:

Tin 97.0%

Antimony 3.0%

A chemical analysis of the above start tube composition resulted in the following percentage weight proportions:

Tin (Balance)

Antimony 3.06%

Copper 0.001%

Arsenic 0.003%

Silver 0.001%

Bismuth 0.005%

Nickel 0.001%

Cadmium 0.001%

Zinc 0.001%

Lead 0.022%

Aluminum 0.001%

Sulfur 0.001%

Indium 0.004%

Phosphorus 0.002%

Gold 0.001%

The same tests were conducted as described in Experiment 1. The results were identical.

EXPERIMENT NO. 3

Mild Detonating Cord (MDC) was produced using the same processes and start tube tin alloy composition as defined in Experiment #1. Detonation velocity at ambient indicated 6600–6700 meters/second VOD. A coreload of 4.5 grains/ft of hexanitrostilbene (HNS) explosive was produced at a diameter of 0.093 inches.

The MDC was taped in the shape of a loop on a 12"×12" piece of 0.358 inch thick stretched acrylic. One end of the MDC was initiated with a #6 blasting cap. The detonation of the MDC shock fractured the acrylic sufficiently to separate the section defined by the taped loop. Results from a lead sheath 4.5 grain/ft HNS length of MDC were identical.

The foregoing experiment indicates that satisfactory ignition and shock fracturing results can be obtained using a tin sheath composition embodying an alloy of tin, antimony and copper; an alloy of tin and antimony or an alloy of tin, copper, silver and bismuth.

EXPERIMENT NO. 4

An ignition cord containing Hydro-Borate/oxidizer igniter powder was produced, using a tin alloy tube composition having the following chemical analysis:

Tin (Sn) 95.01

Antimony (Sb) 2.00

Copper (Cu) 1.56

Lead (Pb) 1.42

Arsenic (As) <0.01

Zinc (Zn) 0.01

Iron (Fe) <0.01

Others (Balance)

Results of testing indicated propagation velocity was within the range determined in Experiment 1.

Lead impurities shown in the following tin-tube analysis vary from 0.09 to 1.42% based on several tube manufacturers' process control procedures.

TIN TUBE ANALYSIS SUMMARY

TIN TUBE ANALYSIS SUMMARY
(REPORTED as Wt %)

| Element | Sample (Atlas) *, ** | Sample D00710-A *, ** | Sample D00710-B ** | Sample Technimet ** | Sample Anderson ** | Sample 62064JP | Requirements Min | Requirements Max |
|---|---|---|---|---|---|---|---|---|
| Antimony (Sb) | 2.00 | 1.79 | 1.83 | 1.94 | 2.09 | 2.45 | 1.00 | 3.00 |
| Arsenic (As) | <0.02 | <0.02 | <0.02 | <0.01 | nd <.01 | <0.02 | — | 0.050 |
| Capper (Cu) | 1.56 | 1.65 | 1.63 | 1.23 | 1.45 | 0.55 | 1.00 | 2.00 |
| Iron (Fe) | <0.02 | 0.004 | 0.004 | 0.009 | 0.004 | 0.006 | — | 0.015 |
| Lead (Pb) | 1.42 | 1.21 | 1.04 | 0.76 | 0.50 | 0.09 | — | 0.050 |
| Tin (Sn) | 95.01 | 95.33 | 95.49 | 96.02 | 95.93 | 96.86 | 95.00 | 98.00 |
| Zinc (Zn) | 0.01 | <0.005 | <0.005 | 0.001 | <0.001 | <0.005 | — | 0.005 |
| Others | Balance | 0.014 | 0.005 | Balance | Balance | 0.023 | | |

| Element | Sample 0029-X | Sample 0030-X ** | Sample 0031-X ** | Sample 0032-X ** | Sample 0033-X ** | Sample XX21 | Requirements Min | Requirements Max |
|---|---|---|---|---|---|---|---|---|
| Antimony (Sb) | 1.81 | 1.98 | 1.95 | 1.90 | 1.94 | 1.80 | 1.00 | 3.00 |
| Arsenic (As) | <0.005 | <0.005 | <0.005 | <0.005 | <.005 | <0.005 | — | 0.050 |
| Copper (Cu) | 1.30 | 1.31 | 1.76 | 1.72 | 1.72 | 1.33 | 1.00 | 2.00 |
| Iron (Fe) | 0.003 | <0.002 | 0.002 | <0.002 | KO.002 | 0.004 | — | 0.015 |
| Lead (Pb) | 0.23 | 1.32 | 1.17 | 1.11 | 1.15 | 0.16 | — | 0.050 |
| Tin (Sn) | 96.65 | 95.38 | 95.11 | 95.26 | 95.18 | 96.70 | 95.00 | 98.00 |
| Zinc (Zn) | <0.005 | <0.005 | <0.005 | <0.005 | <0.005 | <0.005 | — | 0.005 |

*Sample taken from same tube
**Sample taken from same lot of material

It will be understood by those persons skilled in the art that the present tin alloy sheath composition is capable of broad utility and application. Many embodiments and adaptations of the present invention other than those herein described, as well as many variations, modification and equivalent arrangements will be apparent or reasonably suggested, without departing from the substance or scope of the present invention.

We claim:

1. A substantially lead-free, tin alloy ignition cord comprising:

a) a tin alloy sheath having the following percentage weight proportions:
Tin approximately 96.5–98%
Antimony approximately 2 to 3%, and
Lead approximately 0.09 to 1.42%;

b) a fuel/oxidizer pyrotechnic mix core load within said sheath.

2. A substantially lead-free, tin alloy ignition cord as in claim 1, wherein said tin alloy sheath contains copper approximately 0.55 to 1.72 percentage weight.

3. A substantially lead-free, tin alloy sheath material processed as mild detonating cord (MDC) and having the following percentage weight components:

Tin approximately 95 to 97%
Copper approximately 0.55 to 1.76%
Antimony approximately 1.79 to 2.45%
Lead approximately 0.09 to 1.42%

4. A substantially lead-free, tin alloy sheath material containing detonating powder and processed into mild detonating cord (MDC) having the following components:

Tin approximately 95 to 97%
Antimony approximately 1.80 to 2.45%
Lead approximately 0.09 to 1.42%

5. A substantially lead-free, tin alloy sheath material containing detonating powder and processed into linear shaped charge (LSC), said sheath material having the following percentage weight components:

Tin approximately 95 to 97%
Antimony approximately 0.09 to 1.42%
Lead approximately 0.09 to 1.42%.

* * * * *